United States Patent [19]

Fournier

[11] Patent Number: 4,876,418

[45] Date of Patent: Oct. 24, 1989

[54] DEVICE FOR RENDERING CONTACTORS ELECTRICALLY AND MECHANICALLY INOPERATIVE

[75] Inventor: Bernard Fournier, Le Plessis Bouchard, France

[73] Assignee: La Telemecanique Electrique, France

[21] Appl. No.: 211,017

[22] Filed: Jun. 24, 1988

[30] Foreign Application Priority Data

Jun. 26, 1987 [FR] France ..... 87 09341

[51] Int. Cl.[4] ..... H01H 9/24

[52] U.S. Cl. ..... 200/50 C; 335/160

[58] Field of Search ..... 200/50 C; 335/160

[56] References Cited

U.S. PATENT DOCUMENTS 2,525,501 10/1950 Taylor ..... 200/50 C 2,825,239 3/1958 Lauterer ..... 200/50 C 4,513,181 4/1985 Boysen et al. ..... 335/160

*Primary Examiner*—A. D. Pellinen

*Assistant Examiner*—Morris Ginsburg

*Attorney, Agent, or Firm*—William A. Drucker

[57] ABSTRACT

The device for rendering contactors electrically and mechanically inoperative in accordance with the invention comprises a flat modular case, two movement take-offs adapted for coupling respectively with the mobile assemblies of two contactors, two mobile elements providing reciprocal inoperativeness, driven respectively by said movement take-offs and two switch devices whose mobile contact elements are respectively actuated by the mobile elements providing inoperativeness. These two switch devices are mounted in two through current lines directed transversely with respect to the sidewalls of the case.

7 Claims, 4 Drawing Sheets

DEVICE FOR RENDERING CONTACTORS ELECTRICALLY AND MECHANICALLY INOPERATIVE

BACKGROUND OF THE INVENTION

The present invention relates to a device for rendering contactors mechanically and electrically inoperative, in which the original design of the mobile elements makes it possible to obtain an arrangement of the output terminals which facilitates wiring and interchangeability with existing systems providing mechanical inoperativeness.

1. Field of the Invention

It is generally known that devices of this kind providing such inoperativeness are usually associated with contactors for controlling electric motors so as to prevent simultaneous switching on and so short-circuiting particularly when these contactors provide reversal of operation and star-triangle starting.

Such inoperativeness may be electric alone, however, in order to prevent operating errors, it is preferable for it to be both electric and mechanical.

The provision of electric inoperativeness between two contactors consists in actuating, in the first third of the travel of the closing contactor, but preferably as early as possible, a contact which opens the circuit of the coil of the other contactor and vice-versa.

Mechanical inoperativeness uses a system of levers which are interlocked so that when one contactor has begun to close, it is impossible to close the other.

In automatic operation, electric inoperativeness alone would be sufficient. However, in the case of the simultaneous energization of two contactor coils, or in the case of a shock causing the movement of their mobile assemblies, or else in the case of wrong actuation of these contactors, there is a risk of short-circuiting by the simultaneous closure of the power poles of both contactors. This is why mechanical inoperativeness is generally associated with electric inoperativeness.

2. Description of the Prior Art

To provide such mechanical inoperativeness, even in the case of contactors mounted side by side, a locking mechanism is generally used incorporated in a case from which project movement take-off fingers. This case is then placed between two contactors so that the movement takeoff fingers are coupled respectively with actuation members provided in said contactors.

The electric inoperativeness is generally provided by using one of the break contacts (or NC as they are generally called) usually provided on each of the contactors, it being understood that this solution has the drawback of reducing the number of contacts available on each contactor.

To overcome this drawback, a device has been proposed in the form of a module adapted for fitting between the two contactors to be locked and comprising both levers providing mechanical inoperativeness and contacts providing electric inoperativeness. A device of this kind which provides simultaneously mechanical and electric inoperativeness is described in the French patent issued to the firm UNELEC, No. 2 045 090 on May, 30, 1969.

Another more recent and more compact device which can be used between two contactors is described in the PCT patent to ALLEN BRADLEY COMPANY (USA) No. 85 03382 dated Jan. 23, 1984.

It can however be observed that the embodiments proposed in this patent have the drawback that the input and output terminals assigned to one of the contacts are placed on the same side of the case of the device whereas the input and output terminals of the other contact are placed on the other side of this case. This feature, which results from the general design of the device, is particularly troublesome, not only in so far as safety and the simplicity of providing interconnecting wiring are concerned, but also the risks of error which this arrangement may give rise to.

The purpose of the invention is particularly to overcome these drawbacks.

SUMMARY OF THE INVENTION

For this it provides a device rendering contactors electrically and mechanically inoperative of the type comprising:

a flat case with two opposite parallel front walls, spaced a small distance apart and, at least two opposite sidewalls which extend in planes substantially perpendicular to said front walls, this case being formed so as to be able to be mounted between two contactors disposed side by side ;

first and second movement take-offs adapted for respectively coupling with the mobile assembly of the two contactors through substantially coaxial apertures provided in the central regions of the two front walls, each of these two movement take-offs being movable between two positions corresponding respectively to the work position and the rest position of the contactor with which it is associated ;

mobile elements providing reciprocal inoperativeness, driven respectively by said movement take-offs, these mobile elements having a travel distance such that the passage of one of the movement take-offs to the work position brings the element which corresponds with it to a position preventing the passage of the other movement take-off to the work position; and two switch devices each comprising at least one pair of fixed contacts connected respectively by connecting conductors to an input connection element and to an output connection element, and a mobile contact element actuated by a corresponding mobile element providing inoperativeness.

According to the invention, in this device providing inoperativeness said input connection elements are mounted on one of said sidewalls of the case whereas said output connection elements are mounted on the other sidewall, and said switch devices form with the input and output devices which are associated therewith as well as with the corresponding connection conductors, two through current lines, without crossing inside the case and directed transversely with respect to said sidewalls of the case.

BRIEF DESCRIPTION OF THE DRAWINGS

Some embodiments of the invention will be described hereafter, by way of non limitative examples, with reference to the accompanying drawings in which.

DESCRIPTION OF THE PREFERRED EMBODIMENTS

Figure 1:
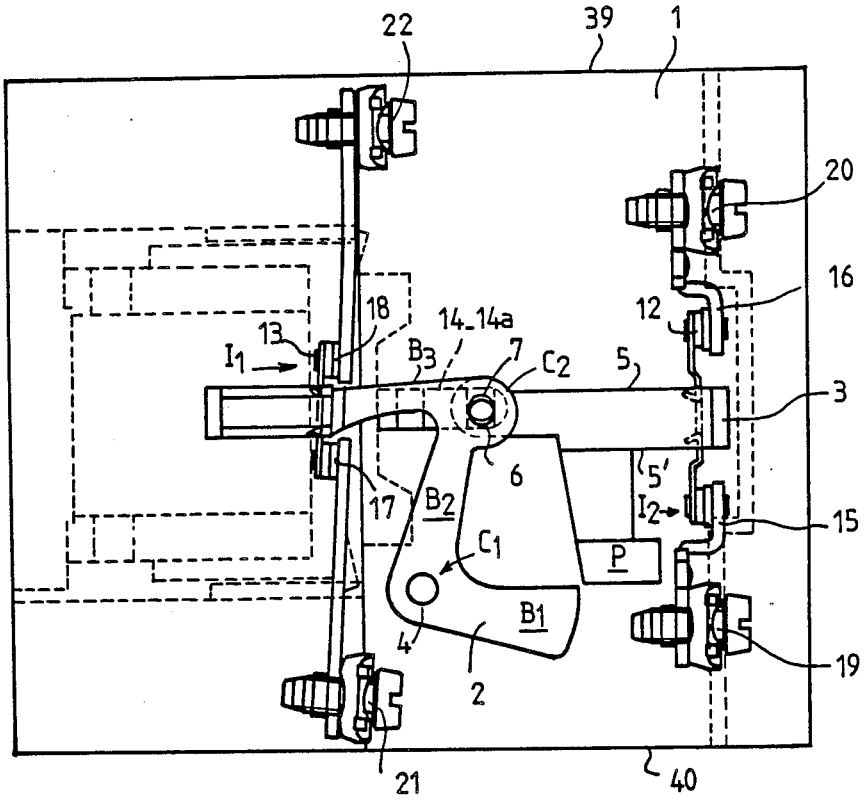
FIG. 1 shows in a front view one embodiment of a device of the invention associated with two contactors in the rest position.

Such as shown in FIGS. 1 to 4, the device providing mechanical and electric inoperativeness comprises :

a support case 1, a lever 2 mounted for rotation about a fixed pin 4 fixed to case 1, this lever 2 being rotated by a first pin 6 adapted for coupling with the mobile assembly of a first contactor, a pusher 3 mounted for sliding inside case 1 along a linear path, by means of slides 5, 5', this pusher 3 being driven by a second pin 7 adapted for coupling to the mobile assembly of a second contactor, two switch devices $I_1$, $I_2$ of the double break contact type whose mobile parts 12, 13 are respectively carried by the pusher 3 and lever 2, preferably via a resilient crushing system, and whose fixed parts each comprise a pair of fixed contact elements 15, 16, 17, and 18 respectively connected to the input and output terminals 19, 21, 20, and 22.

The input terminals 19, 21 are situated on one side 40 of the case (preferably at the level of one of its lateral edges) whereas the output terminals 20, 22 are situated on the other side 39 of the case (preferably at the level of the lateral edge of the case opposite the preceding one), so that when the switch devices $I_1$, $I_2$ are closed, the current lines pass through the case lin a direction substantially perpendicular to that of sides 39, 40.

As mentioned above, lever 2 and pusher 3 are interlocked respectively with the movements of the mobile assemblies of the contactors by means of pins 6 and 7; for this, these pins project on each side of case 1 through openings 14, 14*a* formed in its two opposite front walls, so as to be able to engage in housings provided in the mobile assemblies of the contactors. The edges of the openings 14, 14*a* are oriented in a direction which corresponds to the direction of movement of the mobile assembly of the contactors.

More precisely, lever 2 comprises three arms $B_1$ to $B_3$ joined together by two portions bent substantially at right angles $C_1$, $C_2$ in the following arrangements :

the first arm $B_1$ is adapted so as to occupy a position such as that shown in FIG. 1 in which it extends substantially parallel to the axis of movement of pusher 3 at a given distance therefrom, the second arm $B_2$ is connected to the first arm $B_1$ by the bent portion $C_1$ through which pin 4 passes, and extends in the direction of the axis of movement of pusher 3, the end of this arm situated opposite the bent portion $C_1$ carrying pin 6, the third arm $B_3$ is connected to said end of arm $B_2$ by the bent portion $C_2$ so as to extend, in the position shown in FIG. 1, parallel to and in line with pusher 3, this third arm $B_3$ having at its end the mobile part 13 of the switch device $1_1$.

Pusher 3 comprises a lateral protuberance P oriented towards arm $B_1$ of lever 2 and has at its end opposite the end of arm $B_3$ the mobile part 12 of a switch device $I_2$.

This protuberance P is more particularly adapted so that its area of movement overlaps that of lever 2 and so that conversely, the area of movement of the lever overlaps that of said protuberance P, so as to be able to obtain the following operation.

Figure 2:
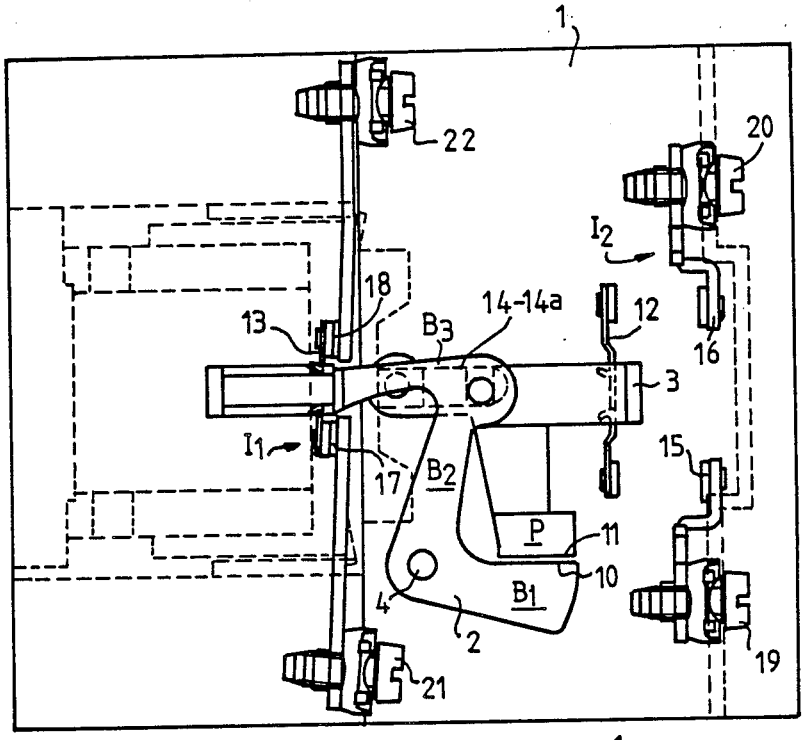
FIG. 2 is a view similar to that of FIG. 1 but in which the first contactor is in the work position and the other is in the rest position.

When the contactor which drives pusher 3 is closed, as shown in FIG. 2, the switch device $I_2$ which is generally placed in series with the coil of the other contactor is open.

If, however, in this position an attempt to close the other contactor is made, tending to move lever 2, the surface 10 of said lever 2 will abut against the surface 11 of protuberance P of said pusher, thus preventing said closure.

Figure 3:
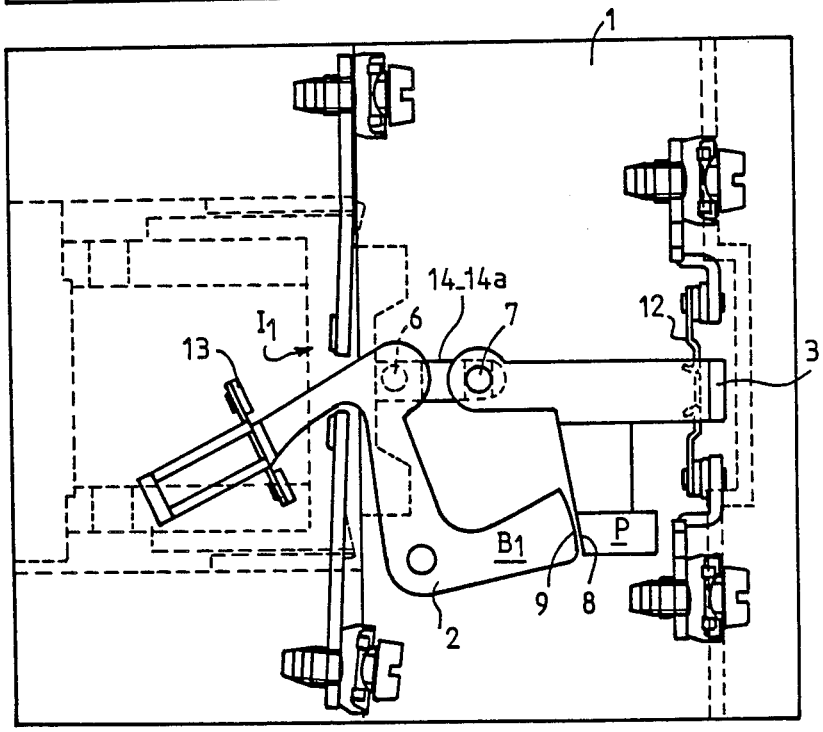
FIG. 3 shows the same device with the first contactor in the rest position and the other in the work position.

Similarly and, in accordance with FIG. 3, when the contactor secured to lever 2 is closed, the switch device $I_1$ generally placed in series with the coil of the first contactor is open. If, in this position, an attempt to close said first contactor is made, the surface 8 of protuberance P of pusher 3 will abut against surface 9 of lever 2 and will prevent said closure.

The mechanical inoperativeness thus achieved, through the combination of the translational/rotational movements of pusher 3 and lever 2, proves very efficient for the movements of surfaces 8 to 11 which block each other are practically perpendicular.

With the above described arrangement and because there is no crossing of electric connections inside case 1, it becomes possible to use a case of small thickness which may readily replace existing cases providing mechanical ioperativeness. Furthermore, the rectilinear or substantially rectilinear movement of the movement take-off parts simplifies adaptation to the mobile assemblies of the contactors.

Figure 4:
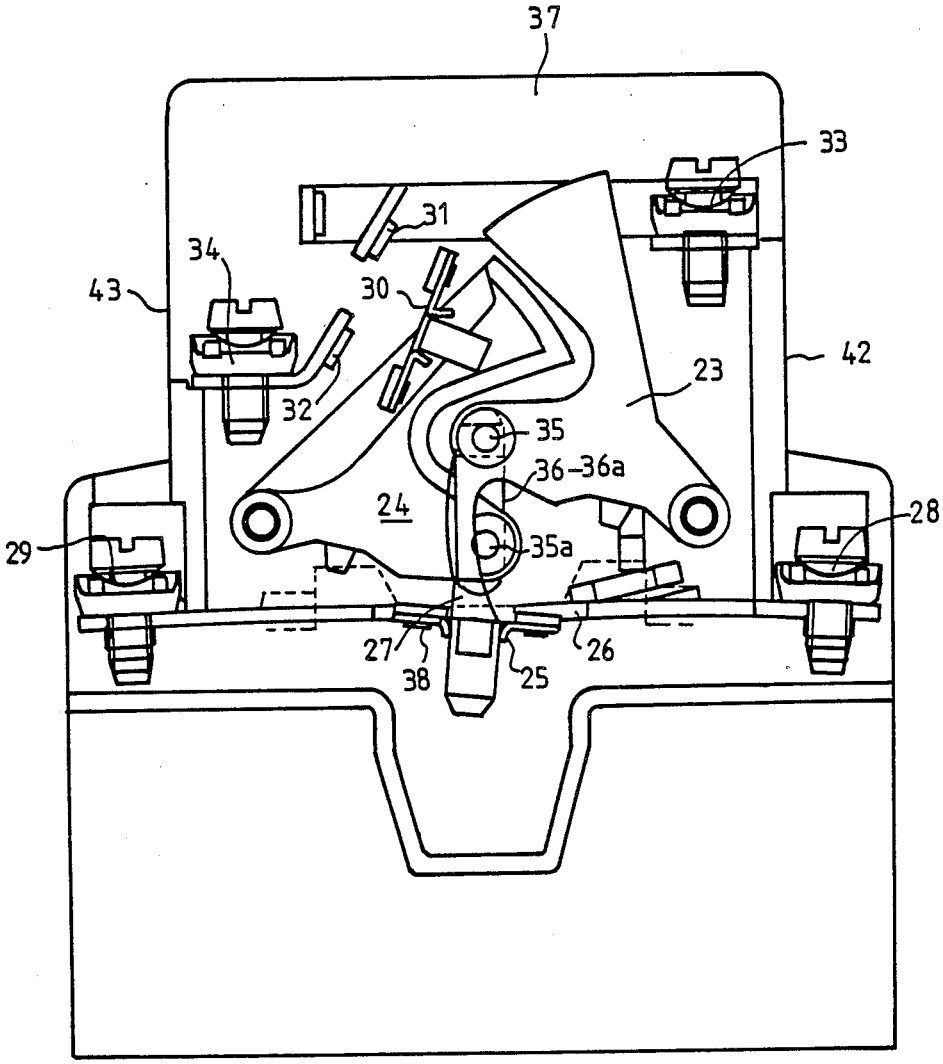
FIG. 4 shows in a front view another embodiment of the device of the invention.

FIG. 4 shows another embodiment of the invention which uses more conventional interlocking levers 23 and 24.

One of levers 23 is modified and comprises an additional arm 38 on which at least one mobile contact 25 is placed which closes the fixed contacts 26 and 27 connected to terminals 28 and 29.

The other lever 24 also has, on a portion close to its locking surfaces, at least one mobile contact 30 which closes the fixed contacts 31 and 32 connected to terminals 33 and 34.

The movement take-offs are conventionally formed by pins 35 and 35*a* passing through the openings 36 and 36*a* in case 37.

The arrangement of the contacts, such as described, also makes it possible to have current paths, passing through the case, substantially perpendicular to the direction of movement of the mobile assemblies of the contactors to be made inoperative, which is materialized by the direction of the openings 36 and 36*a*.

This arrangement and the absence of connection crossings inside the case makes possible as reduced a thickness as possible.

It should be noted that, in this solution, levers 23 and 24 may be made in the same mold, the additional arm 38, required on lever 23, being removed from lever 24 after molding thereof.

It should also be noted that, in the two embodiments, the term input or output for the connection terminals is only given for the sake of clarity of the explanation and in no wise prejudges the actual subsequent assignment of said terminals.

Figure 5:
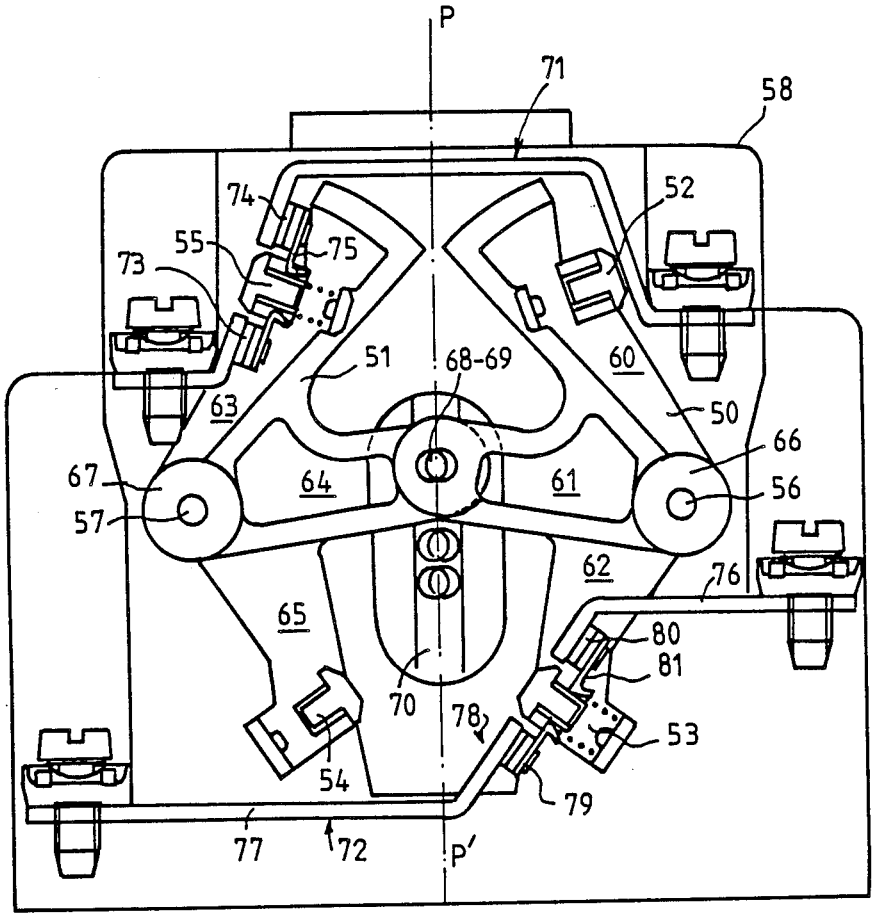
FIG. 5 is a diagrammatical representation of another variant of the device of the invention.

The device shown in FIG. 5 is based on a principle similar to that of the above described example.

However, in this case, the two levers 50, 51 are formed of molded parts of identical shape each having two impressions 52, 53–54, 55 each adapted to receive a mobile contact bridge. These two levers 50, 51 are mounted for rotation about two respective pins 56, 57 disposed symmetrically with respect to the median plane of symmetry P, P' of case 58.

Each of these levers 50, 51 has three arms 60, 61, 62–63, 64,65 disposed in the form of a fork which are connected, by one of their ends to a common region 66, 67 through which one of said pins 56, 57 passes.

Actuation of one of the two levers 50, 51, from a corresponding contactor, is provided by means of a pin 68, 69 mounted on the free end of its central arm 61, 64 and which passes through an oblong aperture 70 centered on the plane of symmetry P, P'.

The other two arms 60, 62–63, 65 of this lever 50, 51 are equipped with reception means (impressions 52 to 55) adapted each for receiving a mobile contact bridge.

As in the above described example, this device comprises two through current lines, namely an upper line 71 and a lower line 72, each of these lines comprising a switch device including two fixed contact elements and a mobile contact bridge carried by a corresponding lever.

The upper through line 71 is formed so as to define in case 58 a free space of substantially trapezoidal shape inside which arms 60, 63 of levers 50, 51, which provide the locking function, may move.

The fixed contact elements 73, 74 of the upper current line 71 are then disposed at the level of one of the oblique sides of said free space and cooperate with a mobile contact bridge 75 carried by the arm of the lever 63.

The lower through line 72 extends in a plane offset with respect to the mean plane in which levers 50, 51 move, so as to facilitate the passage of one 76 of the two conductors 76, 77 of this line.

This through line 72 comprises, opposite the oblique side of the upper line including the fixed contact elements 73, 74 an oblique part 78 including two fixed contact elements 79, 80 which cooperate with a mobile contact bridge 81 carried by the arm of lever 62.

It should be noted that in this case the reception means 52, 54 provided on arms 60, 65 are not used.

The advantages of the above described solution are its simplicity and the fact that, since it only uses a single type of lever, it lends itself better to mass production and is of a lower cost price.

What is claimed is

1. An interlocking device for rendering electrically and mechanically inoperative one or the other of two contactors each having an actuating member, said device of the type comprising:

i- a flat case with first and second opposite parallel front walls, spaced a small distance apart and each having a central region and, first and second opposite sidewalls which extend in planes substantially perpendicular to the first and second front walls, said case having a fixed pin and being adapted for being mounted between the two contactors disposed side by side;

ii- first and second movement take-offs adapted for respectively coupling with the actuating member of the respective contactors through substantially coaxial apertures provided in the central regions of the first and second front walls respectively, each of said first and second movement take-offs being movable between first and second positions corresponding respectively to the work position and the rest position of the contactor with which it is associated ;

iii- first and second mobile elements providing reciprocal inoperativeness, driven respectively by said first and second movement take-offs, said mobile elements having a travel distance such that when the first movement take-off is in its first position, the first mobile element prevents movement of the second movement take-off to its first position and conversely, iv- first and second switch devices respectively comprising first and second pairs of fixed contacts, connected respectively by first and second conductor means to first and second input connection elements and to first and second output connection elements, and first and second mobile contact elements respectively actuated by said second and first mobile elements, said first and second input connection elements being mounted on said first sidewall of the case whereas said first and second output connection elements are mounted on the second sidewall, and said first and second switch devices form with the input and output connection elements which are associated therewith as well as with the corresponding conductor means, first and second through current lines, which do not cross inside the case and are directed transversely with respect to said sidewalls.

2. The device as claimed in claim 1, wherein one of said first and second mobile elements comprises a lever mounted for rotation about said fixed pin, said lever carrying the mobile contact element of one of said first and second switch devices and being driven by one of said first and second movement takeoffs and the other of said first and second mobile elements comprises a pusher mounted for sliding in the case so as to move in translation under the action of the other movement take-off, this pusher carrying the mobile contact element of the other switch device.

3. The device as claimed in claim 2, wherein said pusher has a protuberance whose area of movement overlaps that of said lever so as to provide said inoperativeness.

4. The device as claimed in claim 1, wherein said first and second mobile elements comprise two rotary levers driven by pins, one of these levers comprising an additional arm on which is placed the mobile contact element of one of the switch devices, the other lever having a locking surface and, located in the vicinity of said locking surface, the mobile contact element of the other switch device.

5. The device as claimed in claim 1, wherein said mobile elements comprise two rotary levers of identical shape each having first and second impressions adapted each for receiving one of said mobile contact elements, these levers each having first, second and third arms disposed in the form of a fork, which are connected, by one of their ends, to a common region through which a pivot pin passes, the actuation of each of these levers, from a corresponding one of said two contactors, taking place by means of a pin mounted on the free end of its second arm and the first and third arms of each of these levers respectively comprise said first and second impressions.

6. The device as claimed in claim 5, wherein said first through current line is formed so as to define inside the case a free space shaped as a trapezium having two oblique sides inside which the arms of said levers move and the fixed contacts which define said first through current line are disposed at the level of one of said oblique sides and cooperate with a mobile contact element carried by one of said arms.

7. The device as claimed in claim 5, wherein said second through current line extends in a plane offset with respect to the mean plane in which said levers move, said second through current line including an oblique portion including the two fixed contacts of the second switch device which cooperate with a mobile contact element carried by a lever arm which does not participate in providing mechanical inoperativeness of the device.

* * * * *